US007201626B1

(12) United States Patent
Nelson et al.

(10) Patent No.: US 7,201,626 B1
(45) Date of Patent: Apr. 10, 2007

(54) FLOATATION DEVICE AND ASSOCIATED METHODS

(76) Inventors: Jack E. Nelson, 2887 Notre Dame Ave., Melbourne, FL (US) 32935; Brittney A. Soergel, 2887 Notre Dame Ave., Melbourne, FL (US) 32935

( * ) Notice: Subject to any disclaimer, the term of this patent is extended or adjusted under 35 U.S.C. 154(b) by 0 days.

(21) Appl. No.: 11/316,148

(22) Filed: Dec. 22, 2005

(51) Int. Cl.
*B63C 9/08* (2006.01)

(52) U.S. Cl. ..... 441/106

(58) Field of Classification Search ..... 441/88, 441/102, 106, 108, 114, 115, 116, 119
See application file for complete search history.

(56) References Cited

U.S. PATENT DOCUMENTS

| | | | | |
|---|---|---|---|---|
| 960,129 | A * | 5/1910 | Wilkinson et al. | 441/108 |
| 3,144,668 | A * | 8/1964 | Palesotti | 441/102 |
| 3,540,067 | A | 11/1970 | Deruaz | 9/342 |
| 4,167,051 | A | 9/1979 | Galecke | 9/329 |
| D280,845 | S | 10/1985 | Evert | D21/238 |
| 5,013,271 | A * | 5/1991 | Bartlett | 441/106 |
| 5,030,153 | A | 7/1991 | Bailey | 441/115 |
| D330,740 | S | 11/1992 | Layton | D21/238 |
| 5,184,968 | A * | 2/1993 | Michalochick et al. | 441/106 |
| D359,097 | S | 6/1995 | Crandall et al. | D21/238 |
| D441,517 | S | 5/2001 | Shaffer | D2/717 |
| 6,260,199 | B1 | 7/2001 | Grunstein et al. | 2/69 |
| 2005/0079778 | A1 | 4/2005 | Johnson et al. | 441/106 |

* cited by examiner

*Primary Examiner*—Lars A. Olson
(74) *Attorney, Agent, or Firm*—Mark R. Malek; The Torpy Group, P.L.

(57) ABSTRACT

A floatation device is to be worn by a user and includes a front portion, a pair of opposing side portions connected to the front portion, and a pair of rear portions connected to the respective pair of opposing side portions. Each one of the pair of rear portions includes a first end adjacent the respective side portions, and a second end opposite the first end. The second ends of the pair of rear portions define a floatation device closure that is moveable between an opened position and a closed position. The floatation device also includes at least one pocket adjacent at least one of the front portion, and the pair of opposing side portions.

17 Claims, 4 Drawing Sheets

FLOATATION DEVICE AND ASSOCIATED METHODS

FIELD OF THE INVENTION

The present invention relates to the field of floatation devices and, more particularly, to floatation devices including removable and moveable floatation inserts, and related methods.

BACKGROUND OF THE INVENTION

Floatation devices are generally worn by users to enhance buoyancy. Some floatation devices are shaped like a garment to enhance comfort. For example, U.S. Pat. No. 6,260,199 to Grunstein et al. discloses a garment made of ultra-violet resistant material having buoyant panels adjacent the front and rear portions of the garment.

The Grunstein et al. '199 patent also discloses a roll of soft floatation material positioned adjacent a neck portion of the garment to keep the chin of the user above water. The garment includes leg portions and a zipper adjacent the rear portion, which extends from an upper portion of the garment, halfway down, to the leg portion of the garment. Thereafter, the rear of the leg portion of the garment is closed. The zipper is moveable between opened and closed positions. A user may, however, find it difficult to put the garment on, especially when wet. Further, positioning buoyant panels adjacent the rear portion of the garment may cause a user to float in the water with their back upwards, i.e., face-down, which defeats the purpose of the roll of floatation material positioned adjacent the neck.

U.S. Pat. No. 4,167,051 to Galecke discloses a buoyant life jacket including a series of articulated fabric covered buoyant panels adjacent the front and side portions thereof, and a rear portion comprising lightweight open mesh fabric. A vertical closure is positioned adjacent the front portion of the life vest. A vertical closure adjacent the front portion of the life jacket, however, is disadvantageous as it allows for a younger user, i.e., a child, to readily remove the life jacket.

U.S. Published Patent Application No. 2005/0079778 by Johnson et al. discloses a personal floatation device including front and back covered segments incorporating multiple layers of buoyant material. The personal floatation device includes an upper portion adjacent the torso of a user, and a lower portion to engage the legs of a user. The device also includes a zipper closure that is moveable between opened and closed positions adjacent the upper portion of the device.

Again, and similar to the Grunstein et al. '199 patent, a user may find it difficult to put the device on, especially when wet. Also, positioning the buoyant panels adjacent the rear portion of the garment may cause a user to float in the water with their back upwards, i.e., face-down.

SUMMARY OF THE INVENTION

In view of the foregoing background, it is therefore an object of the present invention to provide a floatation device that is comfortable to be worn for extended periods of time, and that may be worn for participation during water activity, as well as during out-of-water activity. It is also an object of the present invention to provide a floatation device that allows a user to float face-up in the water when being worn. More specifically, it is an object of the present invention to provide a floatation garment that allows a user floating face-down in water to be readily rotated to a face-up position. It is further an object of the present invention to provide a floatation device that is difficult for a younger user, i.e., a child, to remove by himself.

These and other objects, features, and advantages in accordance with the present invention are provided by a floatation device comprising a front portion, a pair of opposing side portions connected to the front portion, and a pair of rear portions connected to the respective pair of opposing side portions. Each of the pair of rear portions includes a first end adjacent the respective side portions, and a second end opposite the first end. The second ends of the pair of rear portions define a floatation device closure that is moveable between an opened position and a closed position. The floatation device may also include a pocket adjacent at least one of the front portion and the pair of opposing side portions.

The pocket may be adjacent an inner portion of at least one of the front portion and the pair of opposing side portions. Further, the floatation device may include first and second opposing pockets adjacent the inner portion of the front portion of the floatation device. Alternately, the floatation device may include first and second opposing pockets adjacent inner portions of each of the respective side portions. Each pocket may comprise a pocket closure adjacent a top portion thereof. The pocket closure may comprise a hook and loop fastener.

The floatation device closure may be a vertical closure. Further, the floatation device closure may comprise at least one of a zipper and a plurality of hook and loop fasteners. This advantageously makes it difficult for a younger user, i.e., a child, to move the floatation device closure to the open position, allowing for removal of the floatation device.

The floatation device may also comprise a floatation insert to be positioned in the pocket. The floatation insert may be a foam floatation insert. The pocket closure may advantageously secure the floatation insert within the pocket. The front portion, the opposing side portions, and the rear portion may be integrally formed as a monolithic unit.

A method aspect of the present invention is for using a floatation device. The method may comprise positioning the floatation device on a user so that the front portion of the floatation device is adjacent a front of a torso of the user. The method may also include inserting a floatation insert into the first and second opposing pockets adjacent the inner portion of at least one of the front portion and the opposing side portions. The method may further include moving the floatation device closure between an opened and a closed position.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
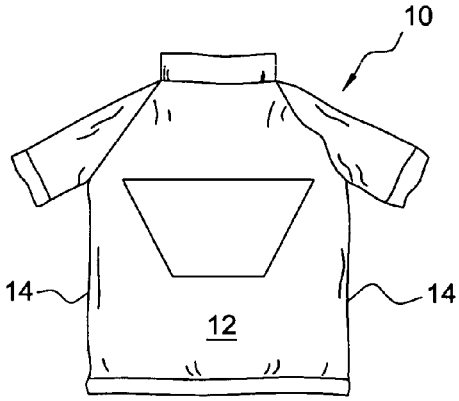
FIG. 1 is a front perspective view of a floatation device according to the present invention.
Figure 2:
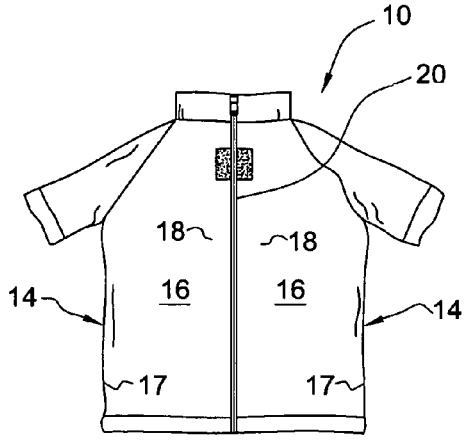
FIG. 2 is a rear perspective view of the floatation device illustrated in FIG. 1.
Figure 3:
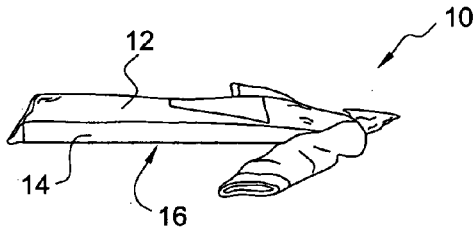
FIG. 3 is a side perspective view of the floatation device illustrated in FIG. 1.

Referring initially to FIGS. 1–3, a floatation device 10 according to the present invention is now described in greater detail. The floatation device 10 illustratively includes a front portion 12 and a pair of opposing side portions 14 connected to the front portion.

The floatation device 10 also includes a pair of rear portions 16 connected to the respective pair of opposing side portions 14. Each one of the pair of rear portions 16 comprises a first end 17 adjacent a respective side portion 14, and a second end 18 opposite the first end. The second ends 18 of the pair of rear portions 16 define a floatation device closure 20 that is moveable between an opened position and a closed position.

Figure 4A:
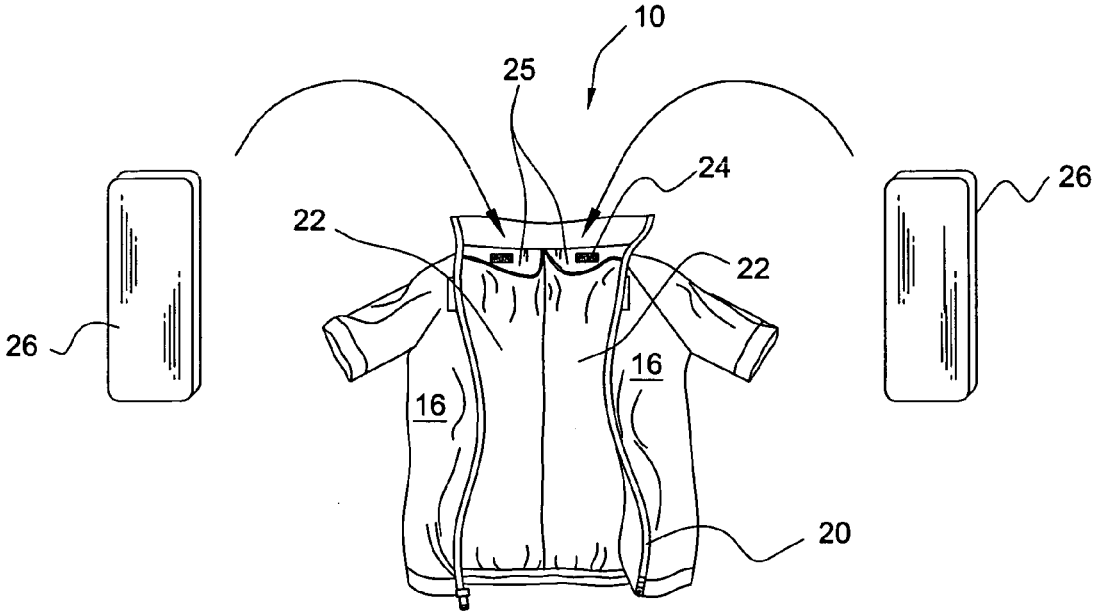
FIG. 4*a* is a rear perspective view of a floatation device illustrated in FIG. 1 and showing a plurality of floatation inserts being inserted into pockets formed adjacent a front portion of the floatation device.
Figure 4B:
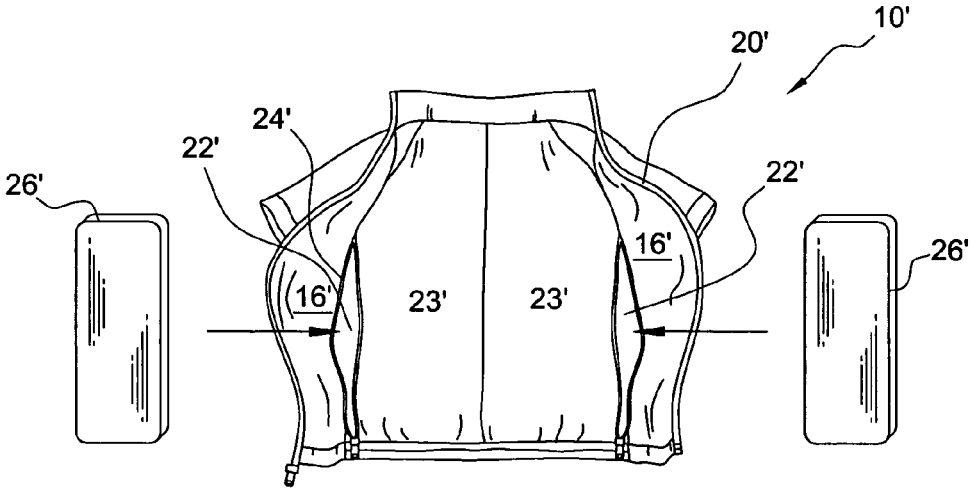
FIG. 4*b* is a front perspective view of the floatation device illustrated in FIG. 1 and showing a plurality of floatation inserts being inserted into pockets adjacent opposing side portions of the floatation device.

Referring now additionally to FIGS. 4*a* and 4*b*, additional features of the floatation device 10 according to the present invention will now be described in greater detail. The floatation device 10 illustratively includes a pocket 22 adjacent at least one of the front portion 12 of the floatation device and the pair of opposing side portions 14 of the floatation device. More specifically, the floatation device 10 may include a pair of pockets 22. As illustrated, for example, in FIG. 4*a*, for example, the pair of pockets 22 may be positioned adjacent an inner portion 23 of the front portion 12 of the floatation device 10. Alternately, and as illustrated in FIG. 4*b*, for example, the floatation device 10 may include opposing pockets 22 adjacent the inner portion 23 of the side portions 14 of the floatation device.

As illustrated in FIGS. 4*a* and 4*b*, the pockets 22 may each include a pocket closure 24. In the embodiment illustrated in FIG. 4*a*, the pocket closure 24 comprises a hook and loop fastener. More specifically, the pocket closure 24 may include a flap 25 that is moveable between opened and closed positions. A first side of the hook and loop fastener may be positioned on the flap 25, while a second side of the hook and loop fastener may be positioned on an outer portion of the pocket 22. When the flap 25 is moved to the closed position, the first side of the hook and loop fastener engages the second side of the hook and loop fastener to securely close the pocket 22. The hook and loop fastener advantageously allows for the flap 25 of the pocket 22 to be readily opened and securely closed.

In the embodiment of the floatation device 10' illustrated in FIG. 4*b*, the pocket 22' is illustrated on opposing side portions 14' of the floatation device. More particularly, the pockets 22' are positioned on the inner portion 23' of the opposing side portions 14'. The pocket closures 24' in this embodiment of the floatation device 10' are provided using a zipper. The other elements of this embodiment of the floatation device 10' are similar to the first embodiment of the floatation device 10, are labelled with prime notation and require no further discussion herein. Although the illustrated embodiments of the floatation device 10, 10' illustrate pockets 22 adjacent the front portion 12 having hook and loop fasteners, and pockets 22' adjacent the side portions 14' having zipper fasteners, those skilled in the art will appreciate that any type of fastener may be used on any type of pocket to secure the pocket closures 24, 24' in a closed position.

As further illustrated in FIGS. 4*a* and 4*b*, the floatation device 10, 10' illustratively includes floatation inserts 26, 26' to be positioned in the pockets 22, 22'. The floatation inserts 26, 26' may, for example, be foam floatation inserts. Those skilled in the art, however, will appreciate that the floatation inserts 26, 26' may be made of any other material having similar density and floatation properties.

Although the illustrations show the floatation inserts 26, 26' being positioned in either of the pockets 22, 22' adjacent the front portion 12, 12' of the floatation device 10, 10' or the pockets adjacent the side portions 14, 14' of the floatation device, those skilled in the art will appreciate that the floatation inserts may be positioned in the pockets adjacent the front portion and side portions of the floatation device, either individually or in any combination thereof.

The floatation inserts 26 are preferably rectangularly shaped. More particularly, the shape of the floatation inserts 26 is preferably similar to the shape of the pocket 22. This advantageously provides a more secure fit of the floatation insert 26 within the pocket 22. Of course, those skilled in the art will appreciate that both the pocket 22 and the floatation insert 26 may have any shape.

Figure 5A:
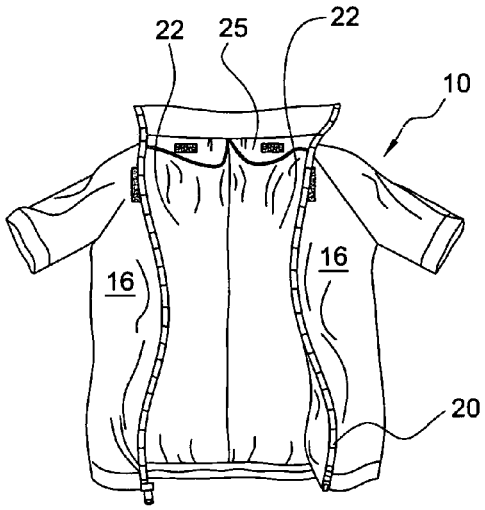
FIG. 5*a* is a rear perspective view of the floatation device according to the present invention and including a floatation device closure comprising a zipper.
Figure 5B:
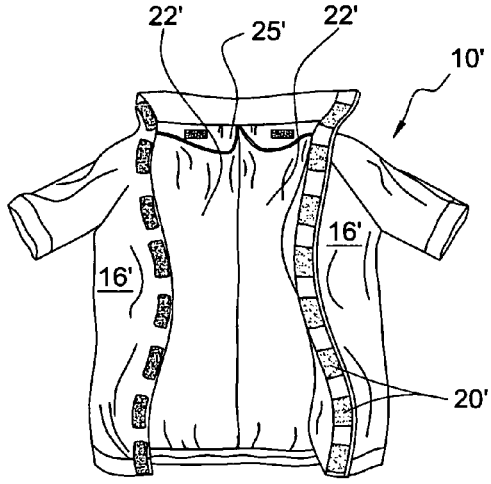
FIG. 5*b* is a rear perspective view of another embodiment of the floatation device according to the present invention, and including a floatation device closure comprising a plurality of hook and loop fasteners.

Referring now additionally to FIGS. 5*a* and 5*b*, an additional aspect of the floatation device 10 of the present invention is now described in greater detail. The floatation device closure 20 is preferably a vertical closure. As illustrated in FIG. 5*a*, one embodiment of the floatation device 10 includes a floatation device closure 20 comprising a zipper. As illustrated in FIG. 5*b*, another embodiment of the floatation device 10' includes a floatation device closure 20' comprising a plurality of hook and loop fasteners. The other elements of this embodiment of the floatation device 10' are similar to the first embodiment of the floatation device 10, are labelled with prime notation and require no further discussion herein. Those skilled in the art will appreciate that the floatation device closure 20, 20' may comprise any other type of fastener suitable for moving any floatation device closure between opened and closed positions.

Figure 6:
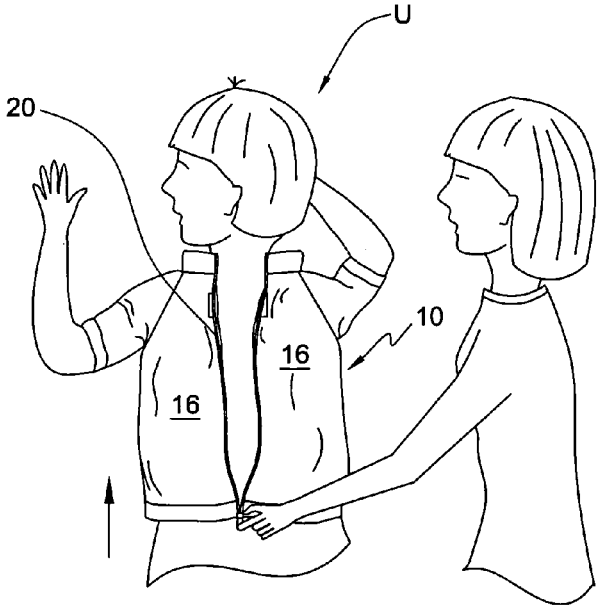
FIG. 6 is an environmental view of a floatation device according to the present invention being positioned on a user.

As illustrated in FIG. 6, the floatation device closure 20 is positioned adjacent the rear portion 16 of the floatation device 10. More specifically, when the floatation device 10 is being worn by a user U, the floatation device closure 20 is preferably positioned adjacent the rear of the torso of the user.

When the user U is a child, this configuration advantageously prevents the child from moving the floatation device closure 20 from a closed position to an opened position, which would allow a child user to readily remove the floatation device 10. Accordingly, the floatation device closure 20 being positioned along the rear portion 16 advantageously makes it difficult for a child user to remove the floatation device 10.

The front portion 12, side portions 14, and rear portions 16 of the floatation device 10 are preferably integrally formed as a monolithic unit. More specifically, the front portion 12, side portions 14, and rear portions 16 of the floatation device 10 are preferably made of a neoprene material. Those skilled in the art, however, will appreciate that the floatation device 10 may be made of any other type of material suitable for immersion in water.

Figure 7A:
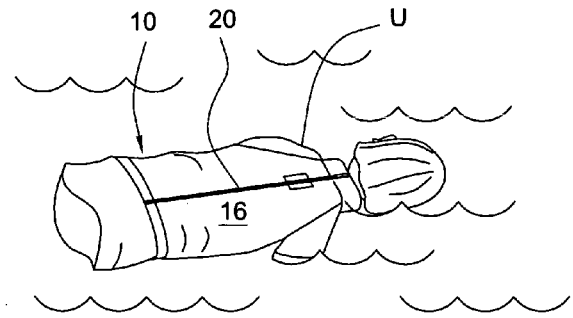
FIGS. 7*a*–7*c* are environmental views of the floatation device according to the present invention being worn by a user in water showing rotation of the user from a face-down position in FIG. 7*a* to a face-up position in FIG. 7*c*.
Figure 7B:
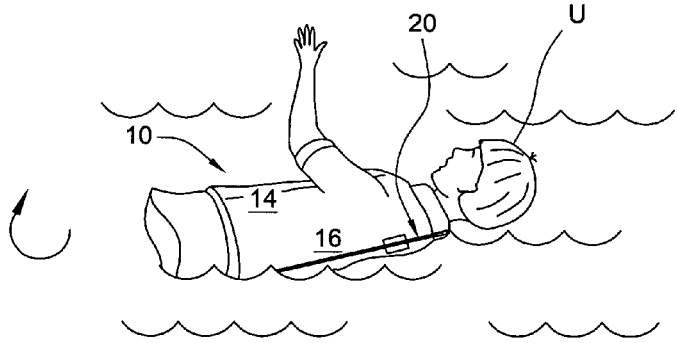
Figure 7C:
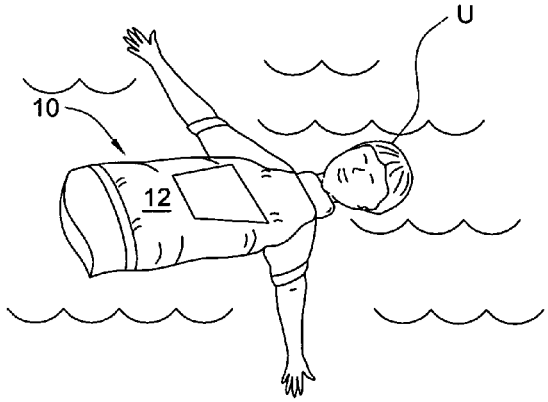

Referring now additionally to FIGS. 7*a*–7*c*, use of the floatation device 10 according to the present invention is now described in greater detail. As discussed above, floatation inserts 26 are preferably positioned within pockets 22 along the front portion 12 of the floatation device 10 and/or along the side portions 14 of the floatation device. Accordingly, floatation inserts are not positioned adjacent the rear portion 16 of the floatation device 10. Therefore, when a user U wears the floatation device 10 in water, the user will tend not to float face-down. Instead, and as illustrated in the series of illustrations beginning with FIG. 7*a*, positioning the floatation inserts 26 adjacent the front 12 and/or side 14 portions of the floatation device 10 advantageously allows for rotation of the user U from an initial face-down position in the water (FIG. 7*a*) to a position face-up in the water (FIG. 7*c*). FIG. 7*b* illustrates a position midway between the rotation from a face-down position to a face-up position.

A method aspect of the present invention is for using the floatation device 10. The method may include positioning the floatation device 10 on a user U so that the front portion 12 of the floatation device is adjacent a front of the torso of the user. The method may also include inserting a floatation insert 26 into pockets 22 on the front portion 12 and/or side portions 14 of the floatation device 10. The method may further include moving the floatation device closure 20 between an opened and a closed position.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A floatation device to be worn by a user and comprising:

a front portion;

a pair of opposing side portions connected to said front portion;

a pair of rear portions connected to said respective pair of opposing side portions, each one of said pair of rear portions comprising a first end adjacent said respective side portions, and a second end opposite the first end, the second ends of said pair of rear portions defining a floatation device closure that is moveable between an opened position and a closed position; and at least one pocket adjacent an inner portion of at least one of said front portion, and said pair of opposing side portions wherein said at least one pocket comprises a pocket closure adjacent a top portion thereof, and wherein said pocket closure is moveable between an opened and a closed position; and at least one floatation insert removably carried by said at least one pocket.

2. A floatation device according to claim 1 wherein said at least one pocket comprises first and second opposing pockets adjacent an inner portion of said front portion.

3. A floatation device according to claim 1 wherein said at least one pocket comprises first and second opposing pockets adjacent inner portions of each of said respective opposing side portions.

4. A floatation device according to claim 1 wherein said pocket closure comprises a hook and loop fastener.

5. A floatation device according to claim 1 wherein said at least one floatation insert is a foam floatation insert.

6. A floatation device according to claim 1 wherein said floatation device closure is a vertical closure; and wherein said floatation device closure comprises at least one of a zipper and a plurality of hook and loop fasteners.

7. A floatation device according to claim 1 wherein said front portion, said opposing side portions, and said rear portions are integrally formed as a monolithic unit.

8. A floatation device to be worn by a user and comprising:

a front portion;

a pair of opposing side portions connected to said front portion;

a pair of rear portions connected to said respective pair of opposing side portions, each one of said pair of rear portions comprising a first end adjacent said respective side portions, and a second end opposite the first end, the second ends of said pair of rear portions defining a vertical floatation device closure that is moveable between an opened position and a closed position, wherein said floatation device closure comprises at least one of a zipper and a plurality of hook and loop fasteners;

at least one pocket adjacent an inner portion of at least one of said front portion, and said pair of opposing side portions wherein said at least one pocket comprises a pocket closure adjacent a top portion thereof, and wherein said pocket closure is moveable between an opened and a closed position, and wherein said at least one pocket closure comprises at least one fastener to hold the pocket closure closed when in the closed position; and at least one floatation insert removably carried by said at least one pocket;

wherein said front portion, said opposing side portions, and said rear portions are integrally formed as a monolithic unit.

9. A floatation device according to claim 8 wherein said at least one pocket comprises first and second opposing pockets adjacent the inner portion of said front portion.

10. A floatation device according to claim 8 wherein said at least one pocket comprises first and second opposing pockets adjacent the inner portions of each of said respective opposing side portions.

11. A floatation device according to claim 8 wherein the at least one fastener of said pocket closure comprises a hook and loop fastener.

12. A floatation device according to claim 8 wherein said at least one floatation insert is a foam floatation insert.

13. A method of using a floatation device including a front portion, a pair of opposing side portions connected to the front portion, and a pair of rear portions connected to the respective pair of opposing side portions, the rear portions having a first end adjacent the respective side portions, and a second end opposite the first end, the second ends of the rear portions defining a vertical floatation device closure, the method comprising:

positioning the floatation device on a user so that the front portion of the floatation device is adjacent a front of a torso of the user;

inserting a removable floatation insert into each of a respective first and second opposing pocket adjacent an inner portion of at least one of the front portion, and the pair of opposing side portions;

moving a pocket closure to a closed position to maintain the removable floatation insert within the packet;

moving the floatation device closure between an opened position and a closed position.

14. A method according to claim 13 wherein the pocket closure comprises a hook and loop fastener; and further comprising securing the pocket closure in the closed position using the hook and loop fastener after the floatation insert has been inserted into the first and second pockets.

15. A method according to claim 13 wherein the floatation device closure comprises at least one of a zipper and a plurality of hook and loop fasteners.

16. A method according to claim 13 wherein the floatation inserts are foam floatation inserts.

17. A method according to claim 13 wherein the front portion, the opposing side portions, and the rear portions are integrally formed as a monolithic unit.

* * * * *